United States Patent [19]

Miles et al.

[11] 4,250,004

[45] Feb. 10, 1981

[54] PROCESS FOR THE PREPARATION OF LOW OVERVOLTAGE ELECTRODES

[75] Inventors: Ronald C. Miles; Larry D. Carpenter, both of Cleveland, Tenn.

[73] Assignee: Olin Corporation, New Haven, Conn.

[21] Appl. No.: 124,510

[22] Filed: Feb. 25, 1980

Related U.S. Application Data

[63] Continuation-in-part of Ser. No. 63,016, Aug. 2, 1979.

[51] Int. Cl.[3] ..... C25B 1/16; C25B 1/26; C25B 11/02; C25B 11/03

[52] U.S. Cl. ..... 204/98; 204/23; 204/35 R; 204/290 R

[58] Field of Search ..... 204/25, 35 R, 98, 128, 204/290 R, 293, 284, 23, 24

[56] References Cited

U.S. PATENT DOCUMENTS

| | | | |
|---|---|---|---|
| 3,291,714 | 12/1966 | Hall et al. | 204/256 |
| 4,104,133 | 8/1978 | Brannan | 204/25 |

OTHER PUBLICATIONS

Australian Patent, Application No. 32105/75.

German Offenlegungsschrift No. 2,807,054 File No. P2807054.4, Appln. Date Feb. 18, 1978 Disclosure Date, Aug. 24, 1978, "Electrode", Yoshio Oda et al.

Netherlands, Appln. No. 75-07550, filed Jun. 25, 1975, laid open to inspection Jan. 20, 1976, "Electrolytic Cathode and Processes for the Manufacture Thereof".

*Primary Examiner*—T. M. Tufariello

*Attorney, Agent, or Firm*—Donald F. Clements; James B. Haglind

[57] ABSTRACT

An improved process is described for the electrodeposition of both a low overvoltage metal and a sacrificial metal onto an electrically conductive substrate. The sacrificial metal is later removed by leaching the electrodeposited substrate with alkali metal hydroxide. The improvement comprises adding a sacrificial metal to the electroplating solution after electrodeposition is initiated. The amount of electric current supplied to the electroplating solution during electrodeposition may be increased or decreased over time intervals to increase the surface area and the electrochemical activity of the electroplated substrate.

44 Claims, No Drawings

PROCESS FOR THE PREPARATION OF LOW OVERVOLTAGE ELECTRODES

This application is a continuation-in-part of copending application Ser. No. 063,016, filed Aug. 2, 1979.

This invention relates to methods for preparing electrodes having reduced overvoltage in electrolytic cells. More specifically, this invention relates to an improved method of depositing low overvoltage metal on the surface of an electrically conductive substrate such as the surface of a hydrogen producing cathode of an electrolytic cell to reduce the hydrogen overvoltage thereof.

It is well known that the voltage drop between an anode and a cathode in an electrolytic cell in which gases are generated at the electrodes is made up of a number of components, one of which is the overvoltage for the particular electrodes employed. In industrial applications of electrolytic cells, it is very important from the viewpoint of operating cost to reduce to a minimum the voltage drop for an electrolytic process. This leads to the use of electrodes having the lowest overvoltage potential in the system employed. For example, in the electrolysis of an aqueous solution of an alkali metal halide such as an aqueous solution of sodium chloride to produce hydrogen, chlorine and sodium hydroxide, the cathode having the lowest hydrogen overvoltage is highly desired.

Because of the large quantities of chlorine and caustic required by a modern society, millions of tons of these materials are produced, principally by electrolysis of aqueous solutions of sodium chloride, each year. A reduction of as little as 0.05 volts in the working voltage of a cell translates into a meaningful economic savings, especially in the light of today's increasing power costs and energy conservation measures. As a result, the electrochemical industry is constantly in search of means which will reduce the voltage requirements for such electrolytic processes.

A number of innovators have produced various coated electrodes for use in electrolytic cells so as to achieve a low overvoltage potential with a cathode of a base material that would otherwise have a somewhat higher overvoltage potential. Typically, electrodes developed in this area can be classified as "sacrificial metal alloy electrodes". This term encompasses electrodes which have a mixture comprising at least two materials deposited on their surfaces in the form of a microporous coating, one material of which is designed to be removed, for example, by contacting with alkali metal hydroxide, before the electrode is put to use. The removal of the sacrificial metal increases both the surface area and the electrochemical activity of the operating electrode thereby reducing overvoltage.

U.S. Pat. No. 4,104,133, issued Aug. 1, 1978 to James R. Branna et al, discloses use of zinc and nickel in an electroplating solution and is said to achieve a lower overvoltage potential with a cathode of a base material that would otherwise have a somewhat higher overvoltage. The teachings of this patent are incorporated herein in its entirety by reference. The aforementioned patent discloses the use of a nickel chloride-zinc chloride electroplating solution with zinc employed therein as a sacrificial metal. The sacrificial metal is in the electroplating solution at the start of electrodeposition. During electrodeposition, an electrodeposited coating is deposited on a metallic substrate. After electrodeposition, an alkali metal hydroxide may be employed to leach out all or a portion of the zinc component of the electrodeposited coating leaving a remaining metal said to exhibit low overvoltage characteristics.

One fundamental persistent problem that can affect such electrodeposition processes is that if there is too much sacrificial metal at the surface of the substrate, the bond between the remaining low overvoltage metal and the substrate is weakened. If the concentration of sacrificial metal is too low in the electrodeposited coating before leaching, the final electrochemical activity can be low after leaching.

Despite the aforementioned teaching, a need still exists in this particular art for an improved method of electrodepositing a low overvoltage metal on an electrically conductive substrate to prepare a cathode which when in operation in an electrolytic cell has a strong bond between the remaining metal and the substrate and a high electrochemical activity.

OBJECTS

It is a primary object of the present invention to provide a method for lowering overvoltage of electrodes in operating electrolytic cells.

It is another object of the present invention to provide a method for preparing a coated electrode which has a high surface area and a high electrochemical activity.

A further object of this invention is to provide an electrode which operates at a reduced overvoltage in electrolytic cells.

A still further object of this invention is to provide a cathode which operates at a reduced hydrogen overvoltage in a chlor-alkali electrolytic cell.

These and other objects of the invention will become apparent to those skilled in the art upon reading the specification and claims.

BRIEF DESCRIPTION OF THE INVENTION

These and other objects of the invention are achieved in a process for preparing an electrode having a reduced overvoltage potential when employed in an electrolytic cell, wherein a low overvoltage metal and a sacrificial metal are electrodeposited onto an electrically conductive substrate by insertion of the electrically conductive substrate into an electroplating solution along with a plating anode, and an electric current is passed between the plating anode and the electrically conductive substrate, and the sacrificial metal is removed from the electroplated substrate by leaching with alkali metal hydroxide. The improvement of this invention comprises:

(a) initiating electrodeposition at a first current density, $CD_1$, (b) after a first time interval , $t_1$, adding a sacrificial metal to the electroplating solution, and (c) after a second time interval, $t_2$, changing the first current density, $CD_1$, to a second current density, $CD_2$. The second current density, $CD_2$, may be greater or smaller than the first current density, $CD_1$. In an embodiment of this invention, after a third time interval, $t_3$, the second current density, $CD_2$, is changed to a third current density, $CD_3$.

DETAILED DESCRIPTION OF THE INVENTION

In the process of this invention, a mixture comprising a low overvoltage metal and a sacrificial metal is electrodeposited onto the clean surface of an electrically conductive substrate.

Typically, electrically conductive substrate include materials employed as electrodes in electrolytic cells, for example, permselective membrane type monopolar or bipolar filter press cells employed in the electrolysis of aqueous solutions of alkali metal halide solutions, in porous or semi-porous diaphragm cells, in ion-exchange membrane cells such as permselective membrane cells and the like.

The electrically conductive substrate is any electrically conductive material having the needed mechanical properties and chemical resistance to the electrolyte solution in which it is to be employed.

The electrically conductive substrate employed such as an electrode may have any given shape or size, which is adapted to the cell, in which the electrically conductive substrate is employed as an electrode. The electrode may have the shape of wire, tube, rod, flat or curved plate, perforated plate, expanded metal, wire gauze, gauze, or porous mixture such as fused metal powder. The electrically conductive substrate can be prepared from any suitable conducting material, such as titanium, zirconium, vanadium, niobium, tantalum, chromium, molybdenum, tungsten, manganese, rhenium, iron, ruthenium, osmium, cobalt, rhodium, iridium, nickel, palladium, platinum, copper, silver, gold, carbon or mixtures thereof. The chosen materials must be suitable for the construction of the desired shape. Preferred electrically conductive substrates are iron, copper, nickel, chromium, and mixtures or alloys thereof. Especially preferred electrically conductive substrates are iron, nickel and copper and alloys thereof, particularly, steel, such as carbon steels, iron/nickel alloys and stainless steels such as iron/chromium alloys and iron/nickel/chromium alloys. Other preferred electrically conductive materials are mixtures of iron and copper and alloys based on nickel such as nickel/copper alloys, nickel/iron alloys, nickel/cobalt alloys and nickel/chromium alloys.

Typical electrically conductive substrates are a metal cathode or a metal anode of an electrolytic cell.

While electrodes may be electroplated without removing the same from an electrolytic cell, as disclosed in U.S. Pat. No. 4,104,133, supra, those of skill in the art will recognize that electrodeposition may be easily accomplished by removing cathodes from the electrolytic cell for cleaning purposes and placed in a suitable cleaning bath.

In the process of this invention, the surface of such electrically conductive substrate is coated conductively with a microporous coating comprised of a mixture of both a low overvoltage metal and a sacrificial metal. As used herein, the term "low overvoltage metal" means a metal or an alloy, which when plated on the surface of an electrically conductive substrate results in a lower overvoltage than that which the electrically conductive substrate would exhibit, if unplated. Overvoltage is defined as $H=Ei-Eo$, where Ei is the electrode potential under load and Eo is the reversible electrode potential independent of IR drop in the electrolyte. A general discussion of overvoltage and to methods of determining the values therefor are found in "Physical Chemistry", Third Edition, Farrington Daniels and Robert A. Alberty, John Wiley & Sons, 1966, in particular pages 265–268, and "Instrumental Methods of Analysis", Hobart H. Willard, Lynne L. Merritt, Jr. and John A. Dean, D. Van Nostrand Company, Inc., Fourth Edition, 1965, in particular pages 620–621. The entire disclosure of these books is incorporated herein by reference.

The low overvoltage metal is a non-noble metal selected from the group consisting of copper, nickel, cobalt, manganese, chromium and iron and alloys thereof. Preferred alloys are, for example, nickel-aluminum and nickel-zinc.

The sacrificial metal is one, which after electrodeposition on the surface of the electrically conductive substrate with the low overvoltage metal in a microporous coating, can be selectively removed later from the microporous coating preferably without removal of significant amounts of the non-noble low overvoltage metal. The selective removal of the sacrificial metal can be achieved by differences in the solubility in a solvnet and by differences in electrochemical activity. Accordingly, useful sacrificial metals are metals, which can be alloyed with the chosen non-noble metal, and which can be selectively removed from the microporous coating applied, and which do not unfavorably influence the potential drop when a portion of the sacrificial metal remains on the electrically conductive substrate after the selective removal operation. The term "sacrificial metal" is employed throughout the description and claims to include metals, which are useful with one or more of the non-noble meals, are aluminum, magnesium, gallium, tin, lead, cadmium, bismuth, antimony, zinc, mixtures thereof and the like, as well as non-metallic materials such as carbon, steel, and phosphorous. Preferred sacrificial metals are aluminum, zinc, magnesium, tin, mixtures thereof and the like.

The above-mentioned sacrificial metals must be selectively adapted to each of the non-noble metals, in connection with the intended removal process of the sacrificial metal and in connection with the intended use of the electrode. One or more of the sacrificial metals may be suitable with one or more of the non-noble metals.

In electrodepositing the microporous coating to the electrically conductive substrate in accordance with the process of this invention, the surface of the electrically conductive sunstrate is first preferably cleaned.

For simplicity, the process of this invention is described as applied to a cathode of an electrolytic cell, although it is recognized that an anode can be similarly employed, as well as any other aforementioned electrically conductive substrate.

The surfaces of the cathode, for example, copper or nickel surfaces, are preferably cleaned in any suitable container or cleaning bath to remove any contaminants that could diminish adhesion of the coating to the cathode by means such as vapor degreasing, alkaline or acid cleaning, chemical etching, sandblasting and the like. The term "clean" as used herein in reference to metal surfaces means a metal surface that is sufficiently free from objectionable organic or inorganic films to allow electroplating of low overvoltage metal adherent coatings thereupon. All or part of the cathode surface may be cleaned depending on the type of electrolytic cell in which the cathode is to be employed.

The cathode is rinsed and cleaned by any manner common in the electroplating art in order to provide a clean surface on the cathodes. Any known cleaner may be used for this purpose. An acid pickle, such as hydrochloric acid, following cleaning is also common in the plating art in order to neutralize any residual alkaline cleaner and also to remove any oxide ions from the cathodes to form a clean cathode.

The cleaned cathode such as a cleaned nickel cathode is then immersed shortly thereafter in an electroplating solution which during electrodeposition will deposit a coating comprised of a low overvoltage metal as an underlayer on the cleaned surface of the cleaned nickel cathode.

The electroplating solution may be any electroplating solution common in the art such as a nickel sulfate, nickel sulfamate, nickel fluoroborate, nickel pyrophosphate, nickel chloride, mixtures thereof and the like which is substantially free of sacrificial metal.

Any of the aforementioned non-noble metals can be employed in the electroplating solution.

Various electroplating solutions are disclosed in the *Guidebook and Directory for Metal Finishing,* Nathaniel Hall-Ed., published by Metals and Plastics Publications, Inc., Hackensack, New Jersey (1977+1980). The disclosure of the aforementioned publications are incorporated herein in its entirety by reference. In particular, at page 266, an electroplating solution commonly known as a Watts bath is disclosed and is shown to contain the following components as shown in Table I:

TABLE I

| Electroplating Solution I | | |
|---|---|---|
| | Concentration Range (Grams Per Liter) | |
| Component | Broad | Preferred |
| $NiSO_4$ | 200–400 | 300–375 |
| $NiCl_2$ | 25–100 | 30–60 |
| Boric Acid | 10–75 | 20–60 |

Other electroplating baths include those shown at pages 276 and 277 of the same article and are summarized in Tables II and III following respectively:

TABLE II

| Electroplating Solution II Chloride-Free Bath: | | |
|---|---|---|
| | Concentration Range (Grams Per Liter) | |
| Component | Broad | Preferred |
| Nickel Sulfamate | 200–600 | 300–500 |
| Boric Acid | 10–50 | 20–40 |
| Antipitting Agent | 0.1–0.5 | 0.3–0.4 |

TABLE III

| Electroplating Solution III Chloride-Containing Bath: | | |
|---|---|---|
| | Concentration Range (Grams Per Liter) | |
| Component | Broad | Preferred |
| Nickel Sulfamate | 100–1000 | 200–900 |
| Nickel Chloride | 2–30 | 5–20 |
| Boric Acid | 20–60 | 30–50 |

Components other than those shown in Tables I, II and III may be employed in the process of this invention. Greater or lesser concentrations of the components shown in Tables I, II or III may be employed as the original electroplating solution.

The cleaned cathode is inserted into an electroplating solution containing a low overvoltage metal free of a sacrificial metal and similar to the electroplating solution shown in Table I above. A plating anode such as an anode comprised of nickel is also inserted in the electroplating solution. The term "plating anode" is used to indicate a soluble or insoluble anode used for the electrodeposition of an electroplated metal coating on the electrically conductive substrate. Typical examples of plating anodes include nickel and alloys of nickel zinc. Any number of plating anodes may be employed in the process of this invention. Combinations of nickel plating anodes and nickel zinc alloy plating anodes may be employed in an embodiment of this invention when at least one nickel plating anode is employed with one or more nickel zinc alloy plating anodes. The electrically conductive substrate is connected to the negative terminal of a direct current supply, and the plating anode is connected to the positive terminal of a direct current supply. The electric current is turned on at a first current density, $CD_1$, and flows between the plating anode and the electrically conductive substrate in a manner such that there results the electrodeposition of low hydrogen overvoltage metal from the electroplating solution onto the cleaned cathode surface so that an underlayer of low overvoltage metal is deposited on the cleaned cathode surface substantially free of sacrificial metal. The first current density, $CD_1$, is in the range from about 0.0001 to about 0.5, and preferably from about 0.001 to about 0.25 ampere per square centimeter.

After electrodeposition has occurred for first time interval, $t_1$, commencing at the beginning of electrodeposition, a sacrificial metal is added to the electroplating solution and the electrodeposition is continued. For example, after electrodeposition has occurred for a first time interval, $t_1$, in the range from about 1 second to about 60 and preferably from about 5 to about 30 minutes, a sacrificial metal, such as zinc, is added to the electroplating solution such as $NiSO_4$-$NiCl_2$-boric acid electroplating solution shown in Table I above.

The sacrificial metal is typically added to the electroplating solution in the form of an aqueous solution, whereby the sacrificial metal is in soluble form and is ionized to form sacrificial metal ions in the electroplating solution.

A sacrificial metal such as zinc metal is typically added in the form of an aqueous solution of zinc halides, preferably zinc chloride. The concentration of $ZnCl_2$ in the solution added to the electroplating solution is in the range from about 1 to about 10,000, and preferably from about 500 to about 4,000 grams $ZnCl_2$ per liter. If desired, the sacrificial metal may be added in solid form, liquid form, or mixtures thereof. It is recognized that the higher concentrations of sacrificial metal may be added in slurry form.

As electrodeposition is continued, a microporous coating comprised of a mixture of sacrificial metal and low overvoltage metal is conductively electrodeposited on the underlayer of low overvoltage metal. The mixture of sacrificial metal and low overvoltage metal is conductive with the underlayer of low overvoltage metal which is substantially free of sacrificial metal. The concentration of sacrificial metal such as $ZnCl_2$ may increase, remain the same, or decrease depending in the rate of addition of sacrificial metal to the electroplating solution and the rate of electrodeposition of the sacrificial metal onto the substrate. Electrodeposition is preferably continued during the first time interval, $t_1$, wherein the concentration of zinc chloride is increased and for a time thereafter.

While the concentration of zinc chloride may be increased by a single or a plurality of additions of the desired amount of zinc chloride, it is preferred to add the zinc chloride slowly over the first time interval as, for example, by the continuous addition of zinc chloride so that the concentration of sacrificial metal ions in the electroplating solution increases while electrodeposition continues.

After a second time interval, $t_2$, commencing with the addition of sacrificial metal to the electroplating solution, the current to the electroplating solution is changed from a first current density, $CD_1$, to a second current density, $CD_2$. The second time interval, $t_2$, is in the range from about 1 second to about 60 and preferably from about 5 to about 30 minutes.

The second current density, $CD_2$, may be greater or smaller than the first current density, $CD_1$.

If desired, after a third time interval, $t_3$, commencing with the change of a first current density, $CD_1$, to a second current density, $CD_2$, the current to the electroplating solution is changed from a second current density, $CD_2$, to a third current density, $CD_3$. The third current density, $CD_3$, may be greater or smaller than the second current density, $CD_2$. The third time interval, $t_3$, is in the range from about 1 second to about 60 and preferably from about 5 to about 30 minutes. Greater or lesser times may be employed in time intervals, $t_1$, $t_2$ and $t_3$. In a preferred embodiment, the second current density, $CD_2$, is smaller than the first current density, $CD_1$, and the third current density, $CD_3$, is greater than the second current density, $CD_2$. Greater or lesser current densities may be employed for current density $CD_1$.

During electrodeposition, the desired microporous coating is conductively applied to the underlayer on the clean cathode to form an electrodeposited cathode. After the current is turned off and electrodeposition is terminated, the microporous coating comprising a mixture of low overvoltage metal and sacrificial metal can easily be further prepared by selectively removing at least a portion of the electrodeposited material, preferably the sacrificial metal portion. A preferred method of removal is contacting the electrodeposited cathode which is coated with the microporous coating comprised of a mixture of low overvoltage metal and sacrificial metal with an alkali metal hydroxide solution, such as an aqueous solution of sodium hydroxide, potassium hydroxide, lithium hydroxide and mixtures thereof, which is sufficient to selectively dissolve the sacrificial metal without attacking or removing the low overvoltage metal portion. However, a small portion of the low overvoltage metal can also be removed without significant damage to the coated substrate. It will be understood that this is merely a preferred method of treating the electrodeposited cathode since it is possible to put the electrodeposited cathode to use in an electrolytic cell for the electrolysis of alkali metal halide brines, the alkali metal hydroxide produced during electrolysis effecting the leaching of the sacrificial metal from the electrodeposited cathode. If, however, contamination by sacrificial metal ion is a problem with respect to the alkali metal hydroxide, then it will be necessary to leach the electrodeposited cathode prior to placing the same in use. The concentration of alkali metal hydroxide of metal dissolving solution is in the range from about 5 to about 50 and preferably from about 10 to about 40 percent alkali metal hydroxide by weight. The temperature of the alkali metal hydroxide solution is in the range of from about 20 to about 60, and preferably from about 40° to about 50° C.

The number of current density variations is in the range from about 1 to about 20 and preferably from about 2 to about 10. The number of current density variations may be increased as needed to further increase the electrochemical activity and surface area of the coated electrically conductive substrate. The current may be increased or decreased during electrodeposition as required to improve the surface area and electrochemical activity of the electroplated cathode.

As a further means of preparing an active coating, the pH may be varied during the electroplating sequence in order to control the composition of the coating. In this embodiment, the pH of the electroplating solution is in the range from about 1.5 to about 6.0 and preferably from about 2.5 to about 5.5.

Without being bound by theory, it is believed that the application of these discoveries as previously described result in maintaining on the electrodeposited cathode the concentration of sacrificial metal such as zinc at a low concentration at a level deep in the microporous coating near the electrically conductive substrate surface such as in the underlayer and at a gradually increasing concentration near the surface of the microporous coating by adding the sacrificial metal to the electroplating solution after electrodeposition has commenced and by varying the current density to regulate the concentration of sacrificial metal throughout the microporous coating. Without being bound by theory, it is believed that a relatively low concentration of sacrificial metal such as zinc, at a level deep in the coating provides for improved adhesion of the electrodeposited materials. It is believed that a relatively high concentration of sacrificial metal near the surface of the applied coating before leaching results in a vastly improved electrochemical activity after leaching. After leaching with alkali metal hydroxide, it is speculated that the loosely adhering but active outer layer may slowly begin to fall off with electrolytic service until the lower firmly adhering underlayer is gradually exposed. It is further believed that as the electrode slowly ages in service, the microporous coating produced by the process of this invention is more likely to be worn away very gradually over a substantially long period of time rather than be completely removed in a relatively short time period. It is also believed that any residual sacrificial metal not removed by leaching is worn away gradually in electrolytic service.

Those of skill in the art will recognize that more than one electroplating solution may be employed. In an embodiment of the invention, a first and a second electroplating solution are employed as the electroplating solutions. The electrically conductive substrate is inserted in a first electroplating solution along with a plating anode and an electric current is passed between the plating anode and the electrically conductive substrate at a first current density, $CD_a$. After a time interval, $t_a$, commencing with the beginning of electrodeposition, the electrically conductive substrate is transferred from the first electroplating solution substantially free of sacrificial metal to a second electroplating solution, the second electroplating solution having a plating anode and containing a sacrificial metal. An electric current is passed between the plating anode and the electrically conductive substrate in the second electroplating solution at a current density, $CD_a$. After a time interval, $t_b$, commencing with the transfer of the electrically conductive substrate from the first electroplating solution to the second electroplating solution, the current density, $CD_a$, is changed to a second current density $CD_b$. In a preferred embodiment, $t_a$ corresponds to $t_1$, $t_b$ corresponds to $t_2$, $CD_a$ corresponds to $CD_1$, and cell $CD_b$ corresponds the $CD_2$. Time interval $t_a$ is in the range from about 1 second to about 60 minutes and preferably in the range from about 5 minutes to about 30 minutes. Time interval $t_b$ is in the range from about 1 second to about 60 minutes and preferably from about 5 minutes to 30 minutes. $CD_a$ is in the range from about 0.0001 to about 0.5 and preferably in the range from about 0.001 to about 0.25 ampere per square centimeter.

Electrodes prepared by the process of this invention may be advantageously employed as cathodes in electrolytic cells for electrolyzing alkali metal halides. Typical alkali metal halides include alkali metal chlorides such as sodium chloride, potassium chloride and mixtures thereof. Typical electrolytic cells include diaphragm cells and membrane cells preferably of a filter press configuration wherein the filter press cell is a monopolar or bipolar electrical operation.

Materials suitable for use as membranes with the electrodes prepared by the process of this invention include sulfonic acid substituted perfluorocarbon polymers of the type described in U.S. Pat. No. 4,036,714, issued July 19, 1977 to Robert Spitzer, primary amine substituted polymers described in U.S. Pat. No. 4,085,071, issued Apr. 18, 1978 to Paul Raphael Resnick et al. polyamine substituted polymers of the type described in U.S. Pat. No. 4,030,988, issued June 21, 1977 to Walther Gustav Grot and carboxylic acid substituted polymers including those described in U.S. Pat. No. 4,065,366, which issued Dec. 27, 1977 to Yoshio Oda et al. All of the teachings of these patents are incorporated herein in their entirety by reference.

Electrodes prepared by the process of this invention may be advantageously employed as anodes in other electrolytic cells as, for example, anodes in electrolyzing water.

While the invention has been described in terms of a nickel-zinc coating, it may be possible to substitute chemical equivalents for either or both of these metals in the subject invention with affecting the result of a lowered hydrogen overpotential at the cathode surfaces. Thus, the nickel component may be replaced with cobalt or an alloy of cobalt and nickel, or ferrous alloys of nickel and/or cobalt. Furthermore, the zinc component may be replaced by cadmium or an alloy of zinc and cadmium.

The following examples are presented to define the invention more fully without any intention of being limited thereby. All parts and percentages are by weight unless indicated otherwise.

EXAMPLE 1

A section of clean flat nickel mesh was selected as the electrically conductive substrate for electroplating. The section was 0.15 centimeter thick, 6.5 centimeters long, and 9.0 centimeters high. The length of the diamond-shaped mesh apertures therein was 0.9 centimeter and 0.4 centimeter wide.

955 Milliliters of an aqueous electroplating solution was prepared having the following composition:

346 g/l $NiSO_4$;
47 g/l $NiCl_2$;
39 g/l boric acid;
the temperature was 25° C.; and
the pH of the electroplating solution was 3.3.

The clean flat nickel mesh was inserted in the electroplating solution and the current turned on at a first current density of 0.05 ampere per square centimeter to deposit an underlayer of nickel metal substantially free of any specified metal at the clean surface of the flat nickel mesh. After a first time interval of 15 minutes, a solution of sacrificial metal (45 milliliters of a 1 kg/l aqueous solution of $ZnCl_2$) was then added to the above-described electroplating solution and the flat nickel mesh was further electroplated. After a second time interval of about one second, the current density was changed to a second current density of 0.001 ampere per square centimeter. After a third time interval of 15 minutes, the current was then increased to a third current density of 0.005 ampere per square centimeter. After a fourth time interval of 15 minutes, the current was then increased to a fourth current density of 0.05 ampere per square centimeter. After a fifth time interval of 15 minutes, the current was then finally increased to 0.10 ampere per square centimeter for an additional 15 minutes. The temperature of the electroplating solution was 25° C. and the plating solution pH was 4.6. The electric supply was then turned off and the electrodeposited flat nickel mesh was removed from the electroplating solution and was leched in an aqueous sodium hydroxide solution.

The leached electrodeposited flat nickel mesh was employed as an operating cathode in a membrane cell used in the electrolysis of sodium chloride brine to produce hydrogen, chlorine, and sodium hydroxide.

The cell employed in Example 1 was a divided flow through cell with a carboxylic acid substituted polymer of the type described in U.S. Pat. No. 4,065,366, issued Dec. 27, 1977 to Yoshio Oda et al employed as the membrane. The electroplated cathode previously described was positioned in the cathode chamber so that the longer dimension of the previously described apertures was aligned horizontally. The louvers were positioned to direct the hydrogen gas upward and away from the membrane.

The anode and cathode were connected to a direct current supply and the electricity was turned on. The hydrogen gas and chlorine gas were collected off the cathode and anode chambers, respectively. An aqueous solution of sodium hydroxide was collected from the cathode chamber.

During electrolysis, the hydrogen overvoltage of the cathode was measured by using a saturated calomel electrode in conjunction with a Luggin capillary positioned 0.5 centimeter from the electroplated cathode on the side of the electroplated cathode facing the membrane.

After startup, the hydrogen overvoltage of the electrodeposited nickel was measured at 130 millivolts (mv) or 255 mv below the hydrogen overvoltage of 385 mv for unplated nickel cathode.

The cell of Example 1 was operated for 200 days at the following condition:

temperature 90° C.;
anolyte concentration 24 percent sodium chloride by weight;
catholyte concentration 35 percent sodium hydroxide by weight;
brine supply rate 15 milliliters per minute; and
water supply rate 1.1 milliliters per minute.

After 200 days, the hydrogen overvoltage of the electrodeposited flat nickel mesh cathode was about 200 mv overvoltage.

EXAMPLE 2

In a manner similar to Example 1, a section of clean flat nickel mesh was placed in an aqueous electroplating solution having the following composition:

6 g/l nickel chloride
450 g/l nickel sulfamate;

30 g/l boric acid;
the temperature of the bath was 50° C.; and
the pH was 3.8.

Initial electrodeposition proceeded at a first current density of 0.032 ampere per centimeter squared for a first time interval of 15 minutes to deposit an underlayer of nickel metal substantially free of any sacrificial metal on the clean surface of the flat nickel mesh. The current was shut off and the flat nickel mesh was transferred to a second electroplating solution having the following composition:

346 g/l nickel sulfate;
47.1 g/l nickel chloride;
38.7 g/l boric acid; and containing 10 g/l $ZnCl_2$ as a sacrificial metal at ambient temperature.

The current was turned on and electrodeposition proceeded for 15 minutes at 0.001 ampere per square centimeter, 15 minutes at 0.005 ampere per square centimeter, 15 minutes at 0.050 ampere per square centimeter, and 15 minutes at 0.100 ampere per square centimeter. The current was turned off and the electrodeposited flat nickel mesh was leached in 20 percent sodium hydroxide for one hour at 50° C.

A polarization scan was run on the leached electrodeposited flat nickel mesh. The results showed about a 75 to 95 mv hydrogen overvoltage.

COMPARATIVE EXAMPLE A

A clean flat nicle mesh was plated for a total of 60 minutes in 990 ml of an electroplating solution having the following composition:

345.6 g/l $NiSO_4$;
47.1 g/l $NiCl_2$;
38.7 g/l $H_3BO_3$; and containing 10 ml of 1 kg/l $ZnCl_2$ as a sacrificial metal at a temperature of 52° C.

The current was first turned on with the sacrificial metal already present in the bath. Electrodeposition proceeded for 30 minutes at 0.001 ampere per centimeter square, 10 minutes at 0.005 ampere per centimeter square, five minutes at 0.01 ampere per centimeter square, five minutes at 0.05 ampere per centimeter square, and 10 minutes at 0.10 ampere per centimeter square. The electrodeposition was then terminated. After leaching in a sodium hydroxide solution at room temperature, the electrodeposited coating pulled away easily from the substrate and flaked badly indicating that the adherence between the electrodeposited coating and the flat nickel mesh substrate after leaching was very weak. The coated substrate was unsuitable for use in an electrolytic cell.

What is claimed is:

1. In a process for preparing an electrode having reduced cathodic hydrogen overvoltage potential in an electrolytic cell, wherein both a low overvoltage metal and a sacrificial metal are electrodeposited onto an electrically conductive substrate by insertion of said electrically conductive substrate into an electroplating solution along with a plating anode, and an electric current is passed between said plating anode and said electrically conductive substrate and the sacrificial metal is removed by contacting with alkali metal hydroxide, the improvement which comprises:

(a) initiating electrodeposition at a first current density, $CD_1$,
(b) after a first time interval, $t_1$, adding a sacrificial metal to said electroplating solution, and
(c) after a second time interval, $t_2$, changing said first current density, $CD_1$, to a second current density, $CD_2$.

2. In a process for preparing an electrode having reduced cathodic hydrogen overvoltage potential in an electrolytic cell, wherein both a low overvoltage metal and a sacrificial metal are electrodeposited onto an electrically conductive substrate by insertion of said electrically conductive substrate into an electroplating solution along with a plating anode, and an electric current is passed between said plating anode and said electrically conductive substrate and the sacrificial metal is removed by contacting with alkali metal hydroxide, the improvement which comprises:

(a) employing as said electroplating solution, a first electroplating solution and a second electroplating solution,
(b) inserting said electrically conductive substrate into a first electroplating solution along with a plating anode,
(c) passing a first electric current from said plating anode to said electrically conductive substrate at a first current density, $CD_1$,
(d) after a first time interval, $t_1$, transferring said electrically conductive substrate from said first electroplating bath to a second electroplating solution, said second electroplating solution having a plating anode and containing a sacrificial metal, and operating at a first current density, $CD_1$,
(e) after a second time interval, $t_2$, changing said first current density, $CD_1$, to a second current density, $CD_2$.

3. The process of claims 1 or 2, wherein said second current density, $CD_2$, is less than said first current density, $CD_1$.

4. The process of claims 1 or 2, wherein said second current density, $CD_2$, is greater than said first current density, $CD_1$.

5. The process of claims 1 or 2, wherein said first time interval, $t_1$, is in the range from about 1 second to about 60 minutes.

6. The process of claim 5, wherein said first time interval, $t_1$, is in the range from about 5 minutes to about 30 minutes.

7. The process of claims 1 or 2, characterized by the further improved step of (f) after a third time interval, $t_3$, changing said second current density to a third current density, $CD_3$.

8. The process of claim 7, wherein said third current density is less than said second current density, $CD_2$.

9. The process of claim 7, wherein said third current density is greater than said second current density, $CD_2$.

10. The process of claim 9, wherein said second time interval, $t_2$, is in the range from about 1 second to about 60 minutes.

11. The process of claim 10, wherein said second time interval, $t_2$, is in the range from about 5 minutes to about 30 minutes.

12. The process of claim 1, wherein the concentration of said sacrificial metal is maintained constant in said electroplating solution by the addition of sacrificial metal during electrodeposition.

13. The process of claim 1, wherein the concentration of the components of said electroplating solution are maintained constant in said electroplating solution by the addition of said components during electrodeposition.

14. The process of claim 2, wherein the concentration of the components of said first electroplating solution are maintained constant by the addition of said components to said first electroplating solution during electrodeposition.

15. The process of claim 2, wherein the concentration of sacrificial metal of said second electroplating solution are maintained constant by the addition of said sacrificial metal to said second electroplating solution during electrodeposition.

16. The process of claim 2, wherein the concentration of said components of said second electroplating solution are maintained constant during electrodeposition by the addition of said components to said second electroplating solution.

17. The process of claim 10, wherein said low overvoltage metal is a metal selected from a group consisting of copper, nickel, cobalt, manganese, chromium, iron, alloys of nickel-aluminum, alloys of nickel-zinc and mixtures thereof.

18. The process of claim 17, wherein said electrically conductive substrate is a material selected from the group consisting of titanium, zirconium, vanadium, niobium, tantalum, chromium, molybdenum, tungsten, manganese, rhenium, iron, ruthenium, osmium, cobalt, rhodium, iridium, nickel, palladium, platinum, copper, silver, gold, carbon or mixtures thereof.

19. The process of claim 18, wherein said electroplating solution is an aqueous solution comprising nickel sulfate, nickel chloride, and boric acid.

20. The process of claim 18, wherein said electroplating solution is an aqueous solution comprising nickel sulfamate, nickel chloride, and boric acid.

21. The process of claim 18, wherein said electroplating solution is an aqueous solution comprising nickel sulfamate and boric acid.

22. The process of claim 18, wherein said electroplating solution is an aqueous solution comprising a nickel compound selected from the group consisting of nickel sulfate, nickel sulfamate, nickel fluoroborate, nickel pyrophosphate, nickel chloride, mixtures thereof and the like.

23. The process of claim 22, wherein said sacrificial metal is a metal selected from the group consisting of aluminum, magnesium, gallium, tin, lead, cadmium, bismuth, antimony, zinc and mixtures thereof.

24. The process of claim 23, wherein said sacrificial metal is an aqueous solution of a zinc halide.

25. The process of claim 24, wherein said zinc halide is zinc chloride.

26. The process of claim 25 wherein said plating anode is comprised of nickel or nickel-zinc alloy.

27. The process of claim 26 wherein a first plating anode and a second plating anode are employed in said electroplating solution.

28. The process of claim 27 wherein said first plating anode is comprised of nickel and said second plating anode is comprised of nickel zinc alloy.

29. The process of claim 28 wherein said alkali metal hydroxide is an aqueous solution of sodium hydroxide.

30. The process of claim 29 wherein said electrically conductive substrate is comprised of a metal selected from the group consisting of nickel, copper, and mixtures thereof.

31. The process of claim 30 wherein said first current density, $CD_1$, is a number in the range from about 0.0001 to about 0.50 ampere per square centimeter.

32. The process of claim 31 wherein said first current density, $CD_1$, is a number in the range from about 0.001 to about 0.25 ampere per square centimeter.

33. The process of claim 32 wherein said sacrificial metal is added to said electroplating solution in a plurality of additions.

34. The process of claim 33 wherein said sacrificial metal is continuously added to said electroplating solution.

35. An electrode prepared by the process of claims 1 or 2.

36. In a method of electrolyzing an aqueous solution of an alkali metal halide in an electrolytic cell employing an anode and a cathode, the improvement which comprises employing as said cathode, a cathode prepared by the process of claims 1 or 2.

37. The process of claim 36 wherein said alkali metal halide is an alkali metal chloride.

38. The process of claim 37 wherein said alkali metal halide is selected from a group consisting of sodium chloride, potassium chloride and mixtures thereof.

39. The process of claim 38 wherein said electrolytic cell is a membrane cell.

40. The process of claim 39 wherein said membrane cell is a filter press cell.

41. The process of claim 40 wherein said filter press cell employs a carboxylic acid substituted membrane.

42. The process of claim 41 wherein said filter press cell is a monopolar electrical operation.

43. The process of claim 42 wherein said filter press cell is a bipolar electrical operation.

44. In a method of electrolysing water in an electrolytic cell employing an anode and a cathode, the improvement which comprises employing as said anode, an anode prepared by the process of claims 1 or 2.

* * * * *